US005853256A

United States Patent [19]

Kim

[11] Patent Number: 5,853,256

[45] Date of Patent: Dec. 29, 1998

[54] TECHNIQUE FOR COMPENSATING FOR A PAPER FEED ERROR IN A PRINTER

[75] Inventor: Kee-Taek Kim, Suwon, Rep. of Korea

[73] Assignee: SamSung Electronics Co., Ltd., Suwon, Rep. of Korea

[21] Appl. No.: 845,101

[22] Filed: Apr. 21, 1997

[30] Foreign Application Priority Data

Apr. 19, 1996 [KR] Rep. of Korea ..... 1996-11959

[51] Int. Cl.[6] ..... B41J 13/00

[52] U.S. Cl. ..... 400/624; 400/629; 400/74

[58] Field of Search ..... 400/595, 611, 400/624, 625, 628, 629, 708, 74

[56] References Cited

U.S. PATENT DOCUMENTS

| | | | |
|---|---|---|---|
| 4,847,633 | 7/1989 | Piatt et al. | 400/611 |
| 4,874,958 | 10/1989 | Sampath et al. . | |
| 5,010,363 | 4/1991 | Higashio et al. . | |
| 5,074,691 | 12/1991 | Kira et al. . | |
| 5,419,547 | 5/1995 | Jeong . | |
| 5,480,247 | 1/1996 | Saikawa et al. | 400/624 |
| 5,486,061 | 1/1996 | Kakuguchi . | |
| 5,495,326 | 2/1996 | Mikida . | |
| 5,515,088 | 5/1996 | Carpentier et al. . | |
| 5,529,414 | 6/1996 | Katano et al. . | |
| 5,534,976 | 7/1996 | Kim . | |
| 5,564,845 | 10/1996 | Yamaguchi et al. . | |
| 5,710,587 | 1/1998 | Suzuki et al. | 400/595 |

*Primary Examiner*—John S. Hilten
*Attorney, Agent, or Firm*—Robert E. Bushnell, Esq.

[57] ABSTRACT

A method of compensating for a paper feed error through automatically reperforming operations to pick up printing paper when the paper feed error occurs includes the steps of: (a) driving a pickup roller, picking up printing paper stacked in a paper cassette, and then, feeding the picked up printing paper to an image forming unit; (b) after picking up the printing paper in step (a), checking to determine whether or not the printing paper has been fed to the image forming unit; and, (c) when it has been determined in step (b) that the printing paper has not been fed and a paper feed error has been generated, again driving the pickup roller, so as to attempt to pick up the printing paper stacked in the paper cassette again.

6 Claims, 3 Drawing Sheets

TECHNIQUE FOR COMPENSATING FOR A PAPER FEED ERROR IN A PRINTER

CLAIM OF PRIORITY

This application makes reference to, incorporates the same herein, and claims all benefits accruing under 35 U.S.C. §119 from an application for *METHOD FOR COMPENSATING PAPER FEED ERROR* earlier filed in the Korean Industrial Property Office on the 19$^{th}$ day of Apr. 1996 and there duly assigned Ser. No. 11959/1996, a copy of which application is annexed hereto.

BACKGROUND OF THE INVENTION

1. Field of the Invention

The present invention relates to a printer, and in particular, to a technique for compensating for a paper feed error therein.

2. Description of the Related Art

The steps of feeding printing papers in a printer is normally as follows. Upon starting a printing operation, a controller turns on a mechanism driving unit to drive various rollers of the printers. Upon turning on the mechanism driving unit, the various rollers of the printer are driven, and in particular, a pickup roller is driven. The pickup roller is touching an uppermost printing paper from among the printing papers stacked in a paper cassette. At this time, when the pickup roller is driven, the uppermost printing paper is inserted into an interior of the printer by the frictional force between the printing paper and the pickup roller. The printing paper is inserted into an interior of the printer, that is, picked up. The picked up printing paper is conveyed to an image forming unit via a register roller, etc.

The printer generally includes a feed sensor to sense whether or not a pickup operation has been satisfactorily performed during the feeding of the printing papers. The feed sensor, located between the pickup roller, and the register roller senses whether or not the printing papers are in their correct location. Upon the command of the pickup operation, the controller senses a sensing signal of the feed sensor, thereby recognizing that the pickup operation has been satisfactorily performed when it is sensed that the printing papers are in their correct location. On the contrary, after the command of the pickup operation, the controller checking the sensing signal of the feed sensor, may recognize that the pickup operation has been unsatisfactorily performed, that is, recognizing the occurrence of a paper feed error when it is sensed that the printing paper did not reach its correct location. When the pickup operation is unsatisfactorily performed, a paper feed error is generated.

Typically, the paper feed error occurs under such situations as when there the frictional force generated between the printing paper and the pickup roller is not enough to pick up the printing paper because the pickup roller is abraded or the surface of the printing paper to be printed is slippery. To prevent the paper feed error from being generated as above, the abraded pickup roller must be replaced with a new pickup roller or the frictional force must be sufficiently generated between the pickup roller and the printing paper by using printing paper having a rougher surface. The above solution for compensating for the paper feed error, however, is not proper. Therefore, in order to conventionally compensate for the paper feed error, the pickup operation must again be performed.

To compensate for the paper feed error in an earlier printer, a user must insert the paper cassette into the printer and then, draw out it therefrom. Besides, the user must not again perform the pickup operation until the user turns on the power supply voltage after first turning off it.

As is apparent from the foregoing, there is a problem with the earlier printer in that the user must again perform the pickup operation of the printer after confirming the occurrence of the paper feed error.

The following patents each disclose features in common with the present invention but do not teach or suggest the specifically recited technique for compensating for a paper feed error in a printer in accordance with the present invention.

U.S. Pat. No. 5,564,845 to Yamaguchi et al., entitled *Continuous Form Printer Having Multiple Feed Sensors And Method*, U.S. Pat. No. 5,534,976 to Kim, entitled *Method For Eliminating A Paper Jam Of An Image Forming System And Apparatus Therefor*, U.S. Pat. No. 5,529,414 to Katano et al, entitled *Paper Feeding Apparatus For Printer*, U.S. Pat. No. 5,515,088 to Carpentier et al., entitled *Method And Device For Controlling The Paper Feed In A Processor-Driven Printer*, U.S. Pat. No. 5,495,326 to Mikida, entitled *Sheet Feeding Control For An Image Forming Apparatus*, U.S. Pat. No. 5,419,547 to Jeong, entitled *Method For Controlling Transmission Paper Feed Of A Facsimile*, U.S. Pat. No. 5,486,061 to Kakuguchi, entitled *Paper Feeding Method And Apparatus For preventing The Double Feeding Of Papers*, U.S. Pat. No. 5,010,363 to Higashio et al., entitled *Image Forming Apparatus Having Sheet Jam Reaction Reset Means*, U.S. Pat. No. 5,074,691 to Kira et al., entitled *Printer With Continuous-Page Sheet Feeder Releasably Engageable Therewith*, and U.S. Pat. No. 4,874,958 to Sampath et al., entitled *Sheet Edge Detector.*

SUMMARY OF THE INVENTION

It is therefore an object of the present invention to provide a technique for compensating for a paper feed error through automatically again performing an operation to pick up printing papers when the paper feed error occurs.

To achieve the above object, there is provided a method for compensating for a paper feed error in a printer, comprising the steps of: (a) driving a pickup roller, picking up printing papers stacked in a paper cassette, and then, feeding the picked up printing papers to an image forming unit; (b) after picking up the printing papers in step (a), checking whether or not the printing papers have been fed to the image forming unit; and, (c) when it has been determined in step (b) that the printing papers were not fed thereto, that is, a paper feed error was generated, driving the pickup roller, thereby again picking up the printing papers stacked in the paper cassette.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT(S)

Now, a preferred embodiment of the present invention will be described in detail with reference to the accompanying drawings.

In the following description, numerous specific details have been set forth to provide a more thorough understanding of the present invention. It will be apparent, however, to one skilled in the art that the present invention may be practiced without these specific details. A detailed description of known functions and constructions unnecessarily obscuring the subject matter of the present invention has been avoided in the present application.

The present invention is applicable to all machinery including an automatic paper feed unit for again feeding printing paper after a paper feed error has occurred. However, hereinafter, a preferred embodiment of the present invention which is applicable to a laser printer will be explained for providing an understanding of the present invention.

Figure 1:
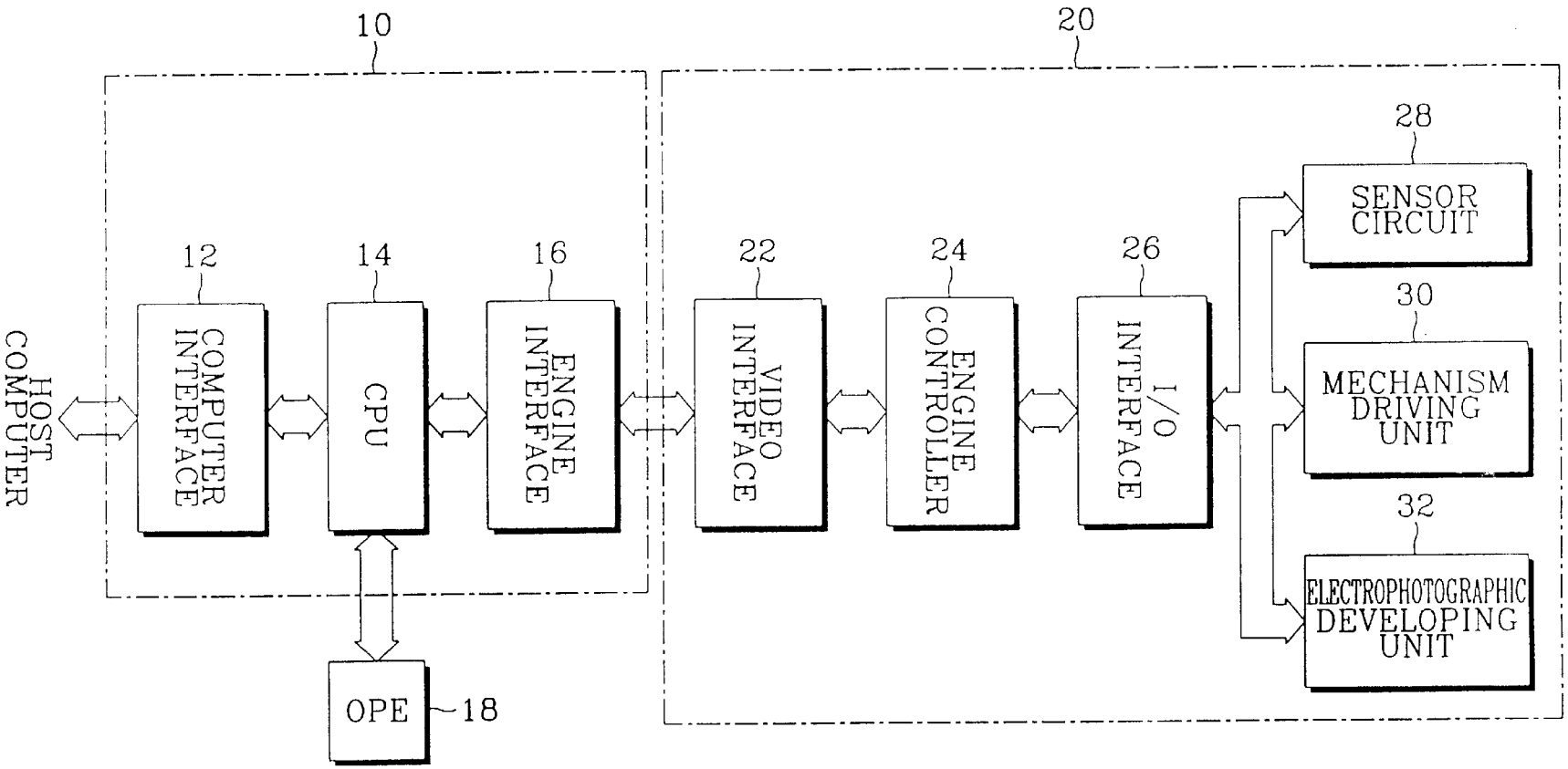
FIG. 1 is a block diagram illustrating the construction of a laser printer.

FIG. 1 is a block diagram illustrating the construction of a laser printer, which includes a video controller 10, a print engine 20, and an operating panel (hereinafter referred to as an OPE) 18.

The video controller 10 is comprised of a computer interface 12, a central processing unit (hereinafter, referred to as a CPU) 14, and an engine interface 16. The computer interface 12 is connected between a host computer and the CPU 14, and interfaces input/output signals therebetween. The CPU 14, comprised of a read only memory (hereinafter, referred to as a ROM) having a controlling program and a random access memory (hereinafter, referred to as a RAM) for temporarily storing various data inputted from the OPE 18 and the host computer, converts printing data received from the computer interface 12 into image data capable of being processed by the print engine 20 and then transmits the converted image data to the print engine 20. Under control of the CPU 14, the engine interface 16 interfaces the input/output signals with the print engine 20.

The OPE 18, controlled by the CPU 14, is comprised of various keys for inputting various commands and a display for displaying information according to the operation of the printer.

The print engine 20 connected to the video controller 10 is comprised of a video interface 22, an engine controller 24, an input/output interface (hereinafter, referred to as an I/O interface) 26, a sensor circuit 28, a mechanism driving unit 30, and an electrophotographic developing unit 32. The video interface 22 interfaces transmission/reception signals between the video controller 10 and the engine controller 24. The engine controller 24 controls the mechanism driving unit 30 and the electrophotographic developing unit 32 under the control of the video controller 10, and prints an image onto the printing paper according to the image data received from the video controller 10. The engine controller 24 senses via the sensor circuit 28 the operational state of various units of the print engine 20, such as the paper feed state, the paper conveyance state, etc. The I/O interface 26, connected to the engine controller 24, the sensor circuit 28, the mechanism driving unit 30, and the electrophotographic developing unit 32, interfaces the input/output signals of the engine controller 24. The sensor circuit 28 drives various sensors for sensing the operational state of the various units of the print engine 20, the paper feed state and the paper conveyance state, the amount of the developing material, etc., and provides sensing signals from each sensor to the engine controller 24. The mechanism driving unit 30 drives various mechanisms required for feeding and conveying the printing papers under the control of the engine controller 24. Under the control of the engine controller 24, the electrophotographic developing unit 32 prints the image onto the printing paper according to the image data.

Figure 2:
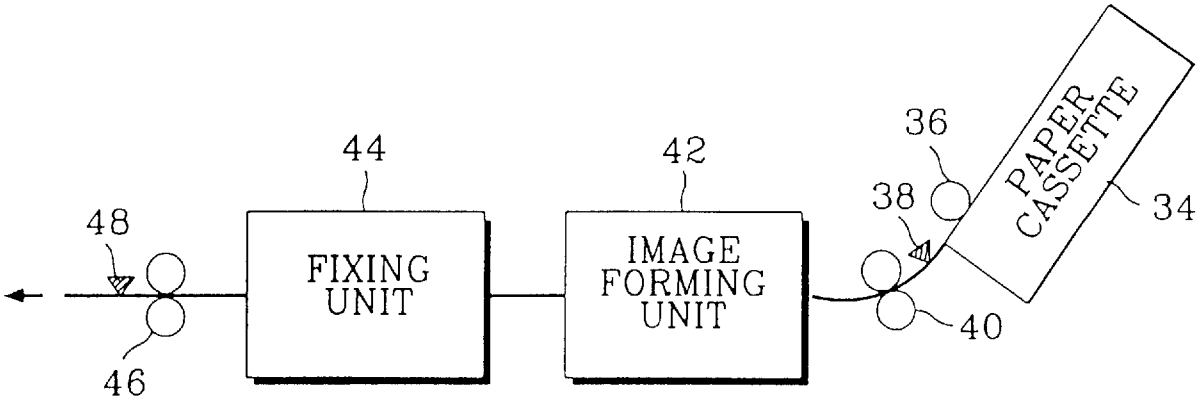
FIG. 2 is a diagrammatic view illustrating an engine of a laser printer.

FIG. 2 is a diagrammatic view illustrating an engine of a laser printer, which includes: a paper cassette 34 for stacking the printing paper; a pickup roller 36 touching an a uppermost printing paper of the printing papers stacked in the paper cassette, for being driven according to driving operation of the mechanism driving unit 30; a feed sensor 38 located between the pickup roller 36 and a register roller 40, for sensing whether or not the printing paper is present at a specific location; the register roller 40 for conveying the fed printing paper to an image forming unit 42; the image forming unit 42 for forming the image onto the printing paper using a developing material; a fixing unit 44 for fixing the developing material to the printing paper; a discharge roller 46 for discharging the printing papers completing an image forming operation, to an exterior of the printer; and, a discharge sensor 48 located in a rear portion of the discharge roller 46, for sensing whether or not the printing paper is present at another specific location.

Figure 3:
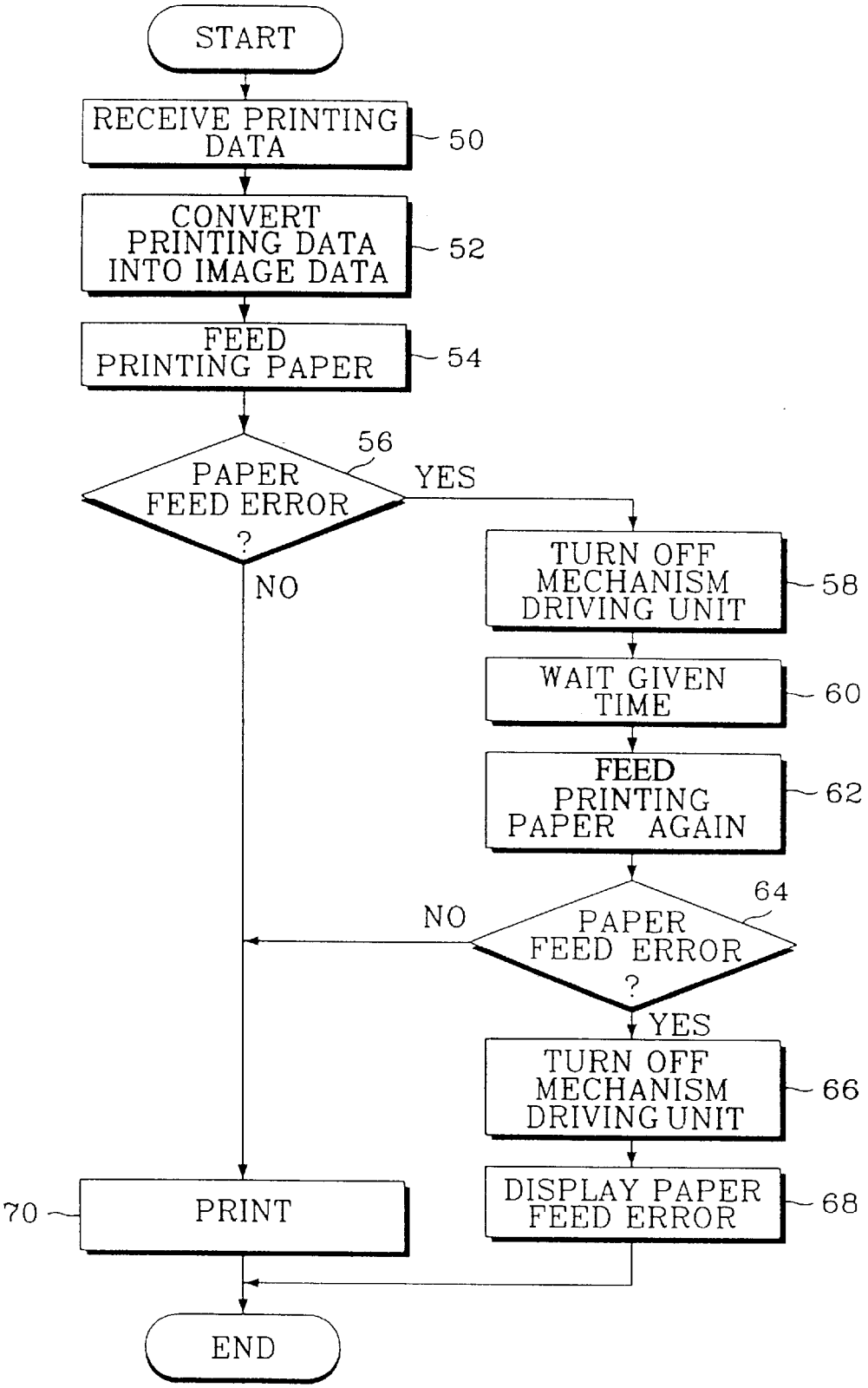
FIG. 3 is a flowchart illustrating a technique for compensating for a paper feed error according to a preferred embodiment of the present invention.

FIG. 3 is a flowchart illustrating a method for compensating for the paper feed error according to a preferred embodiment of the present invention. Referring now to FIG. 1 to FIG. 3, the operation of the laser printer according to the present invention will be described in detail below.

When power supply voltage of the laser printer is turned on, the CPU 14 initializes the laser printer. Upon completion of the initialization, the CPU 14 is placed in its standby state. When the printing data is transmitted from the host computer during the standby state, the CPU 14 receives the printing data from the host computer in step 50. After that, the CPU 14 proceeds to step 52 in order to convert the printing data into the image data capable of processing by the print engine 20 and then, transmits the above image data to the engine controller 24. Thereafter, the engine controller 24 proceeds to step 54, thereby turning on the mechanism driving unit 30 in order to feed the printing papers stacked in the paper cassette 34 to the image forming unit 42. At this time, a main motor (not shown) may be driven by turning on the mechanism driving unit 30. Besides, the pickup roller 36 may be driven according to driving of the main motor.

When the pickup operation is satisfactorily performed, the pickup roller 36 is driven as well as the uppermost printing paper of the printing papers stacked in the paper cassette 34 being picked up. The picked up printing paper is conveyed to the image forming unit 42 via the register roller 40.

However, when the pickup operation is unsatisfactorily performed, the printing paper is not picked up even though the pickup roller 36 is driven.

When the pickup operation is satisfactorily performed after starting the driving of the mechanism driving unit 30, thereby the printing papers reach to the feed sensor 38, the engine controller 24 proceeds to step 56. In the above step 56, the engine controller 24 checks whether or not the sensing signal of the feed sensor 38 exists. Here, when it has been determined that the sensing signal thereof exists, the engine controller 24 recognizes that the pickup operation is satisfactorily performed, while it has been determined that the sensing signal thereof did not exist, the engine controller 24 recognizes that the pickup operation is unsatisfactorily performed, that is, that a paper feed error has occurred.

When the paper feed error occurs, the engine controller 24 proceeds to step 58, while if the paper feed error does not occur, the engine controller 24 proceeds to step 70. In the above step 58, the engine controller 24 turns off the mechanism driving unit 58. As a result, the driving of the main motor as well as the driving of the pickup roller is stopped. After the above step 58, the engine controller 24 proceeds to step 60, thereby waiting a given time. Here, the given time is until the mechanism driving unit 58 is turned off, so that the operation of the pickup roller 36 is completely stopped. After the given time, the engine controller 24 proceeds to step 62, thereby attempting to pick up the printing papers again. At this time, step 62 is equal to step 54. Thereafter, the engine controller 24 proceeds to step 64 and then, checks whether or not the paper feed error has occurred again. Here, step 64 is equal to step 56.

When it has been determined in step 64 that the paper feed error occurred even after picking up the printing papers again, the engine controller 24 proceeds to step 66, otherwise, the engine controller 24 proceeds to step 70.

In step 66, the engine controller 24 turns off the mechanism driving unit 30. Thereafter, the engine controller 24 proceeds to step 68, thereby transmitting a paper feed error occurrence signal to the CPU 14. At this time, the CPU 14 receives the above paper feed error occurrence signal, and then reading the data for displaying the paper feed error from the RAM. After that, the CPU 14 transmits the read data to the OPE 18. Here, the OPE 18 receives the data for displaying the paper feed error and then, displays the received data on the display.

In step 70, the engine controller 24 transmits the image data received from the CPU 14, to the image forming unit 42. Under control of the engine controller 24, the image forming unit 42 forms the image onto the fed printing papers according to the image data. The formed image is fixed according to conveyance of the printing papers to the fixing unit 44. Thereafter, the printing papers are discharged to an exterior of the laser printer via the discharge roller 46.

As state beforehand, when the paper feed error occurs, the present invention can automatically compensate for the paper feed error through picking up the printing papers again. When the paper feed error occurs as before, even after picking up the printing papers again, the paper feed error can be displayed so that the user can process the above paper feed error, so as to perform the printing operations of the laser printer.

Preferred embodiments of the present invention are explained on picking up the printing papers again just one time when the paper feed error occurs. However, when the paper feed error occurs even after picking up the printing papers again, the printing papers can be picked up many times.

While there have been illustrated and described what are considered to be preferred embodiments of the present invention, it will be understood by those skilled in the art that various changes and modifications may be made, and equivalents made be substituted for elements thereof without departing from the true scope of the present invention. In addition, many modifications may be made to adapt a particular situation to the teaching of the present invention without departing from the central scope thereof Therefore, it is intended that the present invention not be limited to the particular embodiments disclosed as the best mode contemplated for carrying out the present invention, but that the present invention includes all embodiments falling within the scope of the appended claims.

What is claimed is:

1. A method of compensating for a paper feed error of a printer, comprising steps of:

(a) driving a pickup roller, picking up printing paper stacked in a paper cassette, and then, feeding said picked up printing paper to an image forming unit;

(b) after picking up the printing paper in step (a), checking whether or not the printing paper has been fed to said image forming unit; and (c) when it has been determined in step (b) that the printing paper has not been fed and a paper feed error has been generated, again driving said pickup roller, so as to attempt to pick up the printing paper stacked in said paper cassette again.

step (c) comprising the steps of:

turning off a mechanism driving unit for driving said pickup roller;

after turning off said mechanism driving unit, waiting until said pickup roller completely stops its driving operation; and turning on said mechanism driving unit again after said waiting state, so as to attempt to pick up the printing paper stacked in said paper cassette by said pickup roller.

2. The method according to claim 1, reperforming step (b) after the performance of step (c).

3. The method according to claim 1, further comprising steps of:

(d) receiving printing data from a host computer;

(e) converting said printing data into image data and then performing step (a); and (f) when it has been determined in step (b) that the printing paper was fed and no paper feed error was generated, printing an image according to said image data.

4. A method of compensating for a paper feed error of a printer, comprising steps of:

(a) receiving printing data from a host computer;

(b) converting said printing data into image data;

(c) after converting said printing data into said image data in step (b), driving a pickup roller, picking up printing paper stacked in a paper cassette, and then, feeding said picked up printing paper to an image forming unit;

(d) after picking up the printing paper in step (c), checking whether or not the printing paper has been fed to said image forming unit;

(e) when it has been determined in step (d) that the printing paper has not been fed and a paper feed error has been generated, again driving said pickup roller, so as to attempt to pick up the printing paper stacked in said paper cassette again;

(f) after picking up the printing paper in step (e) again, checking again to determine whether or not said picked up printing paper has been fed to said image forming unit;

(g) when it has again been determined in step (f) that the printing paper has not been fed and a paper feed error was generated, displaying the paper feed error; and (h) when it has been determined in step (d) or step (f) that the printing paper has been fed and a said paper feed error has not been generated, printing an image according to said image data;

step (e) comprising the steps of:

turning off a mechanism driving unit for driving said pickup roller;

after turning off said mechanism driving unit, waiting until said pickup roller completely stops its driving operation; and turning on said mechanism driving unit again after said waiting, so as to attempt to pick up the printing paper stacked in said paper cassette by said pickup roller.

5. A method of compensating for a paper feed error, comprising steps of:

(a) driving a pickup roller, picking up paper stacked in a paper cassette, and then, feeding said picked up paper to a predetermined location;

(b) after picking up the paper in step (a), checking whether or not the paper has been fed to said predetermined location; and (c) when it has been determined in step (b) that the paper has not been fed and a paper feed error has been generated, again driving said pickup roller, so as to attempt to pick up the paper stacked in said paper cassette again;

step (c) comprising the steps of:

turning off a mechanism driving unit for driving said pickup roller;

after turning off said mechanism driving unit, waiting until said pickup roller completely stops its driving operation; and turning on said mechanism driving unit again after said waiting state, so as to attempt to pick up the paper stacked in said paper cassette by said pickup roller.

6. The method according to claim 5, reperforming step (b) after the performance of step (c).

* * * * *